US006511199B1

(12) United States Patent
Chung

(10) Patent No.: US 6,511,199 B1
(45) Date of Patent: Jan. 28, 2003

(54) CONSTRUCTION OF HAND TOOL SET

(76) Inventor: Chih-Wen Chung, No.21,Alley 32, Lane 64, Lung-Chuan St., Chung-Li City, Taoyung Hsien, Taiwan (CN)

( * ) Notice: Subject to any disclaimer, the term of this patent is extended or adjusted under 35 U.S.C. 154(b) by 0 days.

(21) Appl. No.: 09/743,958

(22) PCT Filed: Jul. 22, 1998

(86) PCT No.: PCT/CN98/00130

§ 371 (c)(1),
(2), (4) Date: Jan. 18, 2001

(87) PCT Pub. No.: WO00/05038

PCT Pub. Date: Feb. 3, 2000

(51) Int. Cl.[7] ..... B25B 23/18

(52) U.S. Cl. ..... 362/119; 362/120; 81/437; 81/438; 81/439; 81/440

(58) Field of Search ..... 362/119, 120; 81/437–439, 440, 177.4, 490

(56) References Cited

U.S. PATENT DOCUMENTS 1,128,165 A * 2/1915 Mace
2,726,695 A * 12/1955 Halm
3,892,149 A * 7/1975 Rydberg ..... 81/71
4,010,663 A * 3/1977 Rydberg ..... 81/71
4,327,790 A * 5/1982 Stevens et al. ..... 145/62
4,440,048 A * 4/1984 Stevens et al. ..... 81/440
4,476,751 A * 10/1984 Mishima ..... 81/440
5,803,584 A * 9/1998 Chung ..... 362/120
6,332,384 B1 * 12/2001 Cluthe ..... 81/490

* cited by examiner

*Primary Examiner*—Thomas M. Sember
*Assistant Examiner*—Jacob Y. Choi
(74) *Attorney, Agent, or Firm*—Rosenberg, Klein & Lee

(57) ABSTRACT

Disclosed is an innovated structure for hand tools comprising a tool accommodation apparatus and a lighting equipment for supplementary lighting or an emergency lighting source. The tool accommodation apparatus further includes a took set installed therearound consisting several kinds of hand tool. The structure is characterized in that when the tools are to be used, a selected tool is pushed forwardly and upwardly from its fixed position to the top end of the tool accommodation apparatus ready for use.

6 Claims, 4 Drawing Sheets

CONSTRUCTION OF HAND TOOL SET

BACKGROUND OF THE INVENTION

1. Field of the Invention

The present invention relates to an innovative structure for hand tools, and more particularly, to a tool set which contains various hand tools available for selection by users for different applications. Furthermore, the present invention is a further innovative invention to the previous invention titled "Structure of Hand Tool" with patent applied for under U.S. application Ser. No. 08/834,139.

2. Description of the Prior Art

Presently, most of the repair works for private housing, home furniture and electric appliances or painting are done by way of do-it-yourself thus avoiding high labor cost. Sometimes people like to create their own unique home furniture expressing their own characteristics.

In response to such particular needs, there are many kinds of hand tools in the present market which make it difficult for users to select a proper one.

A conventional tool set provides a commonly used handle bar with an universal adaptor to which individual tools are attached for different purposes and use. Such a bulky and heavy kit case containing numerous component tools is not only inconvenient to carry around at the working site but also makes it inconvenient for users to quickly replace component tools while working. Furthermore, the component tools are easily mislaid unless the user is very careful.

In order to solve the above mentioned problems existing in a conventional hand tool set, the present invention discloses an innovative structure for hand tools, which at least mitigates the above disadvantage.

SUMMARY OF THE INVENTION

It is a first object of the present invention to provide an innovative structure for hand tools in which all component tools are gathered together for the user to conveniently select proper ones for use.

It is second object of the present invention to provide an innovative structure for hand tools which enables tools to be easily returned to their original place and stored to prevent their loss as is frequently experienced with conventional kinds of tools.

It is a third object of the present invention to provide an innovative structure for hand tools which includes lighting equipment for lighting the area at the working end of the tool, and if necessary, to be used as a flashlight for emergency lighting.

To achieve these and other objects, the structure for hand tools of the present invention comprises a tool storage means and lighting equipment. The tool storage means further includes a tool set installed around the tool storage means, while the lighting equipment is installed within the tool storage means. When in use, a desired tool is swung from it stored position to extend and be retained projecting forwardly and in axial alignment with the tool storage means.

BRIEF DESCRIPTION OF THE DRAWINGS

The drawings disclose an illustrative embodiment of the present invention which exemplifies the various advantages and objects hereof and are as follows.

DETAILED DESCRIPTION OF THE PREFERRED EMBODIMENT

Figure 1:
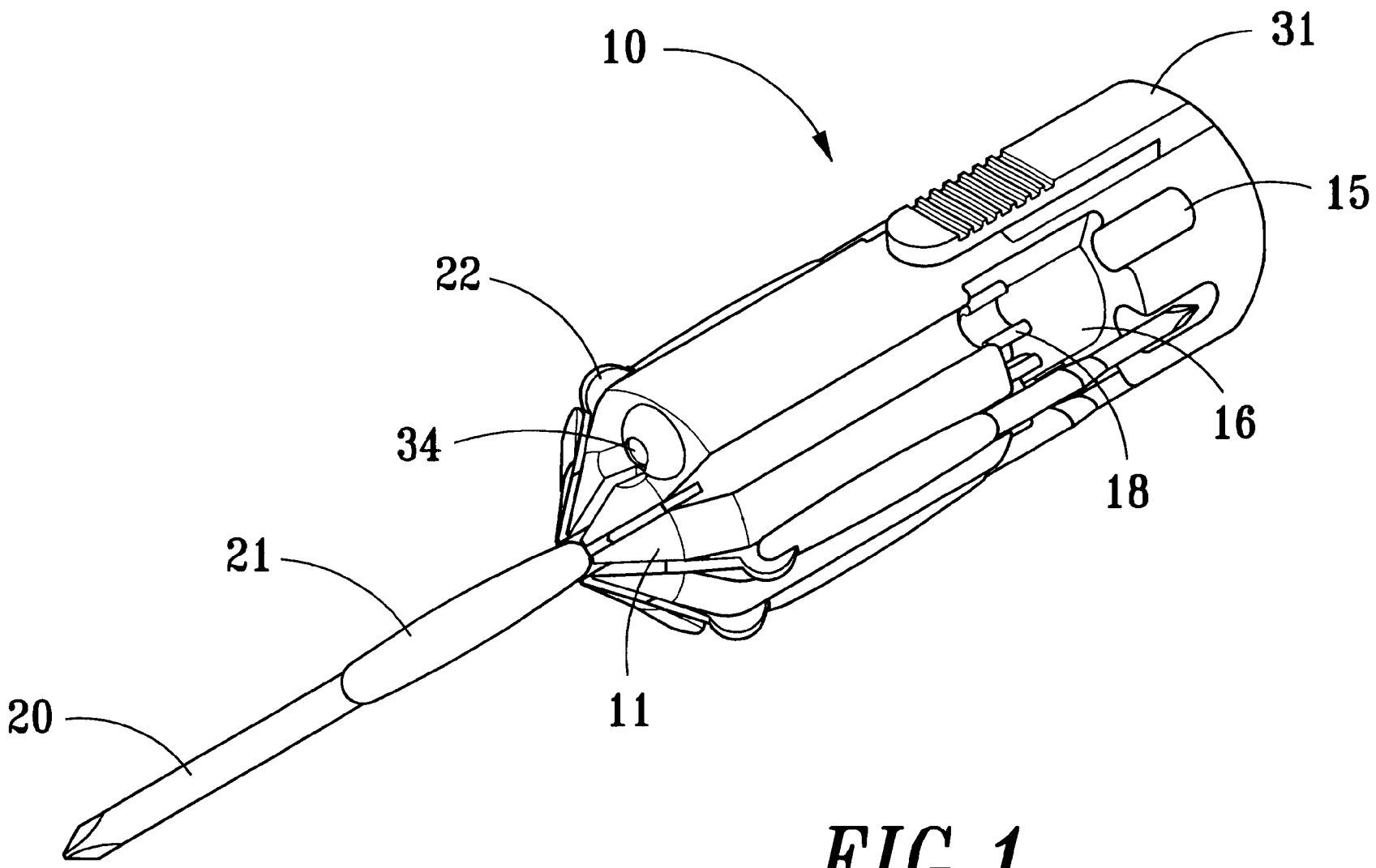
FIG. 1 is a three dimensional drawing of the structure for hand tools of the present invention.
Figure 2:
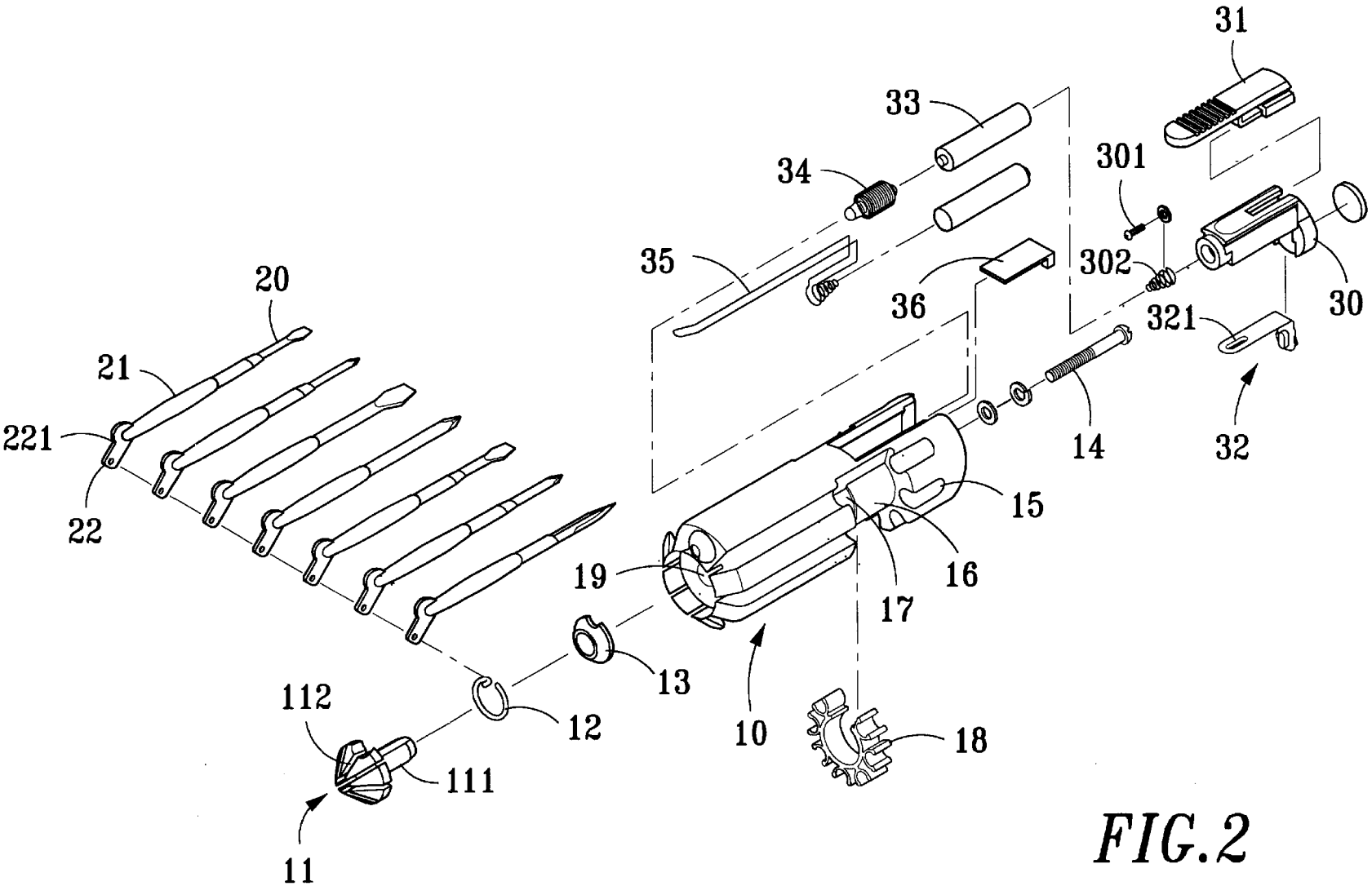
FIG. 2 is a three dimensional exploded drawing of the structure for hand tools of the present invention.

Referring to FIGS. 1 and 2, both show drawings of the innovative structure for hand tools of the present invention. The structure forms a tool storage means which comprises a substantially cylindrical main body 10, provided with a plurality of longitudinally extending tool storage slots 15 around the surface of main body 10. An axial hole 19 in the body opens at the center of the front end of the main body 10 for receiving a fixing screw 14. An inwardly extending radial groove 16 which is deeper than the tool storage slots 15 is formed near the rear end of the main body 10. A cone shaped securing base 11 having a plurality of radial slots 112, is attached to the front end of the main body 10. A collar ring 12 is provided for the securing base 11 to connect through each slot 112. A holding stud 111 extends from the bottom of the base 11.

An annular cap 13 for the holding stud 111 of the securing base 11, is inserted into a hole 19 formed axially into the main body 10. The fixing screw 14 inserted from the other end of the hole 19 is screwed into the holding stud 111 to secure the main body 10, cap 13 and securing base 11 together.

A tool set consisting of several kinds of hand tool 20 is accommodated in the tool storage means. The inoperative end of each hand tool 20 is secured to one end of an extension 21 the other end being formed for connection to a link 22 so that the tool may be linked in series to the collar ring 12 of the securing base 11 with the link engageable in a slot 112 formed in the securing base 11. A projection 221 provided on each connecting link 22 is used to selectively retain the connecting link 22 in the holding stud 111 of the securing base 11. Each hand tool 20 in the tool set is respectively stored in the tool storage slot 15. A second inwardly extending radial groove 17 deeper than the groove 16 is provided on the main body 10 in front of the groove 16 for retaining a tool holder ring 18 for separately holding each hand tool 20 securely and firmly to the main body 10.

Figure 5:
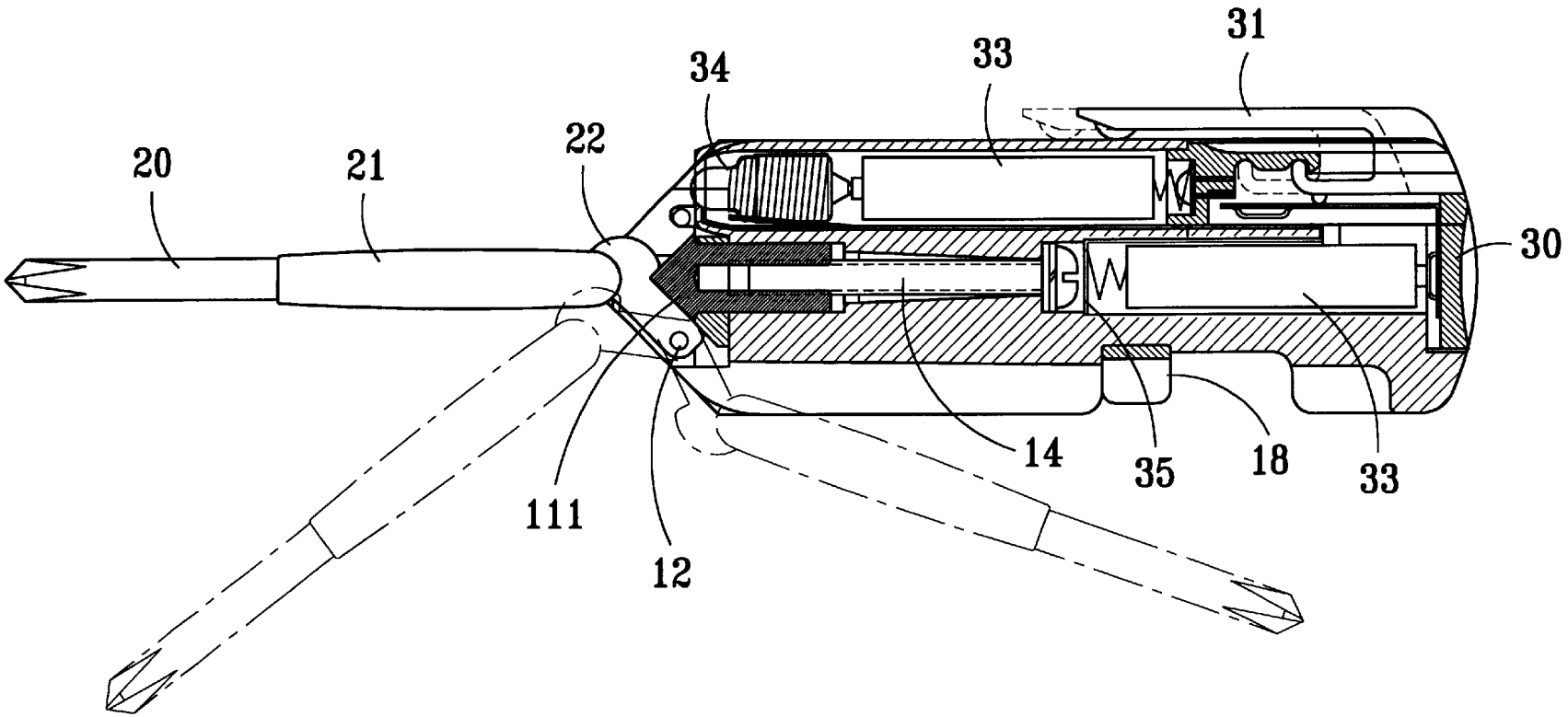
FIG. 5 is a drawing illustrating the operational principle of the structure for hand tools according to the present invention.

Referring to FIG. 5, when it is desired to use a selected hand tool 20 from the tool set, the selected tool 20 may be taken out of its associated groove 16 in the main body 10 and swung forwardly in front of the end of the securing base 11 supported by cap 13. In this position, the tool 20 is held on the holding stud 111 by engagement of the projection 221 on the connecting link 22 engaging in appropriate slot 112 in the base 11. Only a small force is required to set the tool to project in axial alignment with the body 10. The tool 20 is securely engaged in this position by the collar ring 12.

Figure 3:
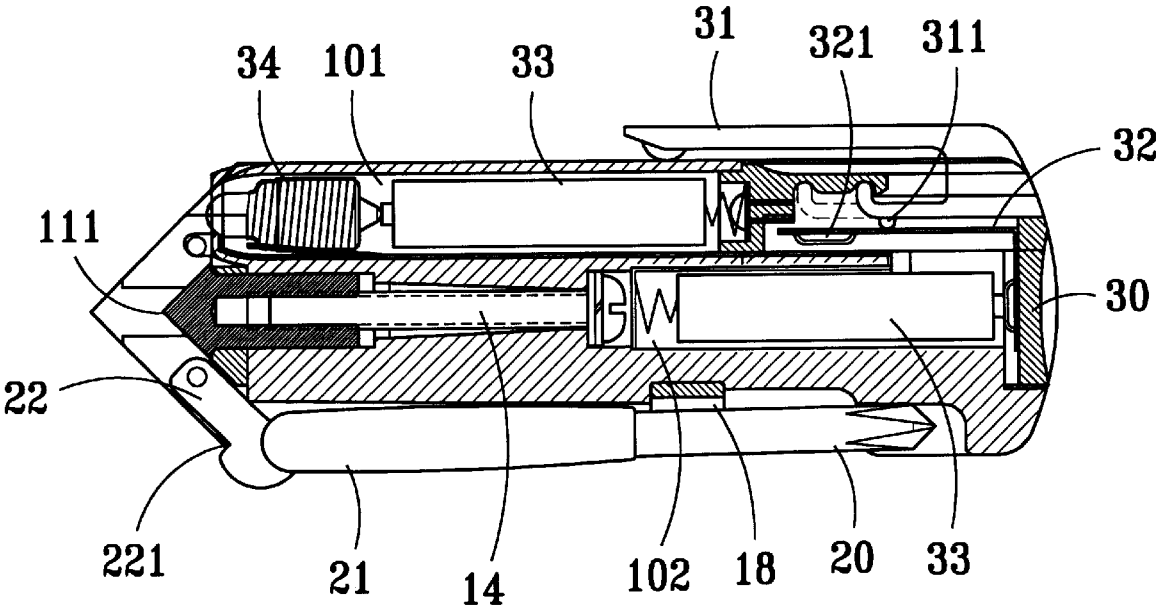
FIG. 3 is a cross sectional drawing of the structure for hand tools of the present invention.

FIGS. 2 and 3 show lighting equipment provided in the tool storage means in order to provide supplementary illumination for the user. The lighting equipment is installed in the upper and lower holes 101, 102 which are formed in the main body 10. The lower hole is an enlargement at the rear end of the axial hole 19. The lighting equipment further includes a switch unit having a slide switch base 30. The slide switch 31 may include a resilient clip to facilitate carrying of the tool structure. The slide switch 31 is installed on the switch base 30 and able to slide to and fro. A protrusion, 311 is formed under the slide switch 31 which is able to move along with the slide switch 31 to interrupt the circuit. Adjacent to the switch base 30 there is a L shaped conducting reed 32 with its long side extended into the upper slot hole 101, and a depression 321 is formed at the front end of the long side of the conducting reed 32. If long side of the reed 32 is pressed downward by the protrusion 311, the lighting circuit will be interrupted. The short side of the conducting reed 32 extends downward to the opening of the lower hole 102.

A conducting spring 302 provided at the front end of the switch base 30 is secured to the front portion of the switch base 30 by a conducting fixing screw 301. The lighting equipment includes a power source unit having two batteries 33 one disposed in the upper and the other in the lower hole 101 and 102 in the main body 10 respectively. The upper hole 101 is open at the front and houses the upper half section of a conducting strip 35, an electric bulb 34, and a battery 33. In the lower hole 102, the lower half section of the conducting strip 35, the other battery 33 and the switch unit are sequentially disposed. The conducting strip 35 connects the bulb 34 to a terminal of the battery 33 in the lower hole 102 is connected to the short end of the conducting reed 32.

Figure 4:
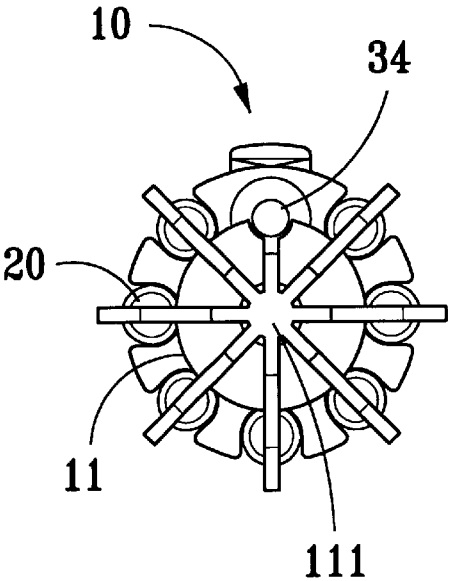
FIG. 4 is a side view drawing of the structure for hand tools of the present invention.

Referring to FIGS. 4 and 5, when the lighting equipment is to be used, the slide switch 31 is pushed forward to cause the protrusion 311 to drop into the depression 321 formed at the long side of the conducting reed 32 thereby flexing this side of the conducting reed 32 upward to contact the conducting fixing screw 301 provided in front of the switch base 30. At this time the circuit for the lighting equipment is closed to form an electric path to the bulb 34 resulting in the emission of light from the front of the upper hole 101.

Referring again to FIG. 2, tag plate 36 is provided between the upper and lower holes 101 and 102 to display necessary instructions and illustrations in relation to operation of the tools.

In conclusion, the innovative structure for hand tools according to the present invention has many advantages compared to conventional structures some of which are as follows:

1. Various hand tools are assembled together for the user to select conveniently and efficiently.
2. The tools can be easily returned to their original storage place to prevent loss or misplacement.
3. The lighting equipment provided by the present invention may be used to light the working area and if necessary, serve as a flashlight for emergency lighting.
4. The resilient clip facilitates the portability of the structure.

Many changes and modifications to the above described embodiment of the invention can, of course, be carried out without departing from the scope thereof. Accordingly, the invention as disclosed is intended to be limited only by the scope of the appended claims.

What is claimed is:

1. A hand tool set comprising:

a substantially cylindrically shaped main body having a plurality of longitudinally extending tool storage slots formed in an outer surface of the main body in angularly spaced relationship, the main body having a centrally disposed axial hole formed therethrough, the main body having a first annular groove formed near a rear end thereof, the first annular groove having a depth that is deeper than a depth of the tool storage slots;

an annular cap disposed on a front end of the main body overlaying the axial hole;

a securing base having a cone shaped outer wall with a plurality of slots formed radially therein, the securing base including a collar ring extending transversely through each of the plurality of slots, the securing base including a holding stud having a top end extending toward a vertex on an inner side of the outer wall, the holding stud having a rear end passing through an opening in the annular cap into the axial hole of the main body;

a fixing screw inserted into the axial hole of the main body through the rear end thereof to engage the rear end of the holding stud; and, a tool set including a plurality of different hand tools respectively disposed in the plurality of tool storage slots, a proximal end of each hand tool being coupled to a link pivotally disposed in a respective one of the slots of the securing base, each link being pivotally coupled to the collar ring of the securing base, each link having a portion thereof adapted for engaging the top end of the holding stud of the securing base against a bias force of the collar ring;

whereby a desired hand tool is grasped within the first annular groove of the main body and pulled outwardly and pushed upwardly to advance the hand tool to an upright position at a top end of the securing base, the desired hand tool being held in the upright position by the bias force produced by the collar ring.

2. The tool set as claimed in claim 1, further comprising an annular tool holder ring for securely holding the plurality of hand tools within the storage slots, the main body having a second annular groove formed adjacent the first annular groove, the second annular groove being deeper than the first annular groove, the second annular groove receiving the annular tool holder ring therein.

3. The tool set as claimed in claim 1, further comprising lighting equipment disposed in the main body for use as a supplementary lighting source.

4. The tool set as claimed in claim 3, wherein said main body includes an upper opening and a lower opening, said lighting equipment having a lighting circuit and being installed in said upper and said lower openings, said lighting equipment further including:

a switch unit having a slide switch and a switch base, said slide switch being installed on said switch base to be able to move to and fro with a protrusion provided on an underside thereof to follow the movement of said slide switch for interrupting the circuit, a conducting reed being provided adjacent to said switch base with a depressed portion formed at a front end thereof, wherein when said depressed portion is pressed downward by said protrusion, the lighting circuit will be interrupted, a conducting spring provided at a front end of said switch base is engaged thereto with a conducting fixing screw; and a power source unit including two batteries each respectively disposed in said upper and said lower openings, said upper opening being a through hole in which an upper half section of a conducting strip, a light bulb, and a battery are sequentially disposed, while in said lower opening, a lower half section of said conducting strip, the other battery, and said switch unit are sequentially disposed therein, said conducting strip electrically connects said light bulb to a terminal of said other battery in said lower opening, while the other terminal of said other battery in said lower opening is connected to an end of said conducting reed;

pushing said slide switch forward makes said protrusion drop into said depressed portion formed at the front end of said conducting reed thereby bouncing said conducting reed upward and contacting said conducting fixing screw provided in said front end of said switch base to close the electric circuit for powering said light bulb to emit light from said upper opening.

5. The tool set as claimed in claim 4, further comprising a tag plate provided between a border of said upper and said lower openings for carrying an instruction and illustration related to operation of said tool set.

6. The tool set as claimed in claim 4, wherein said slide switch includes a pen hook shaped portion, said pen hook shaped portion being resilient and providing a gripping force to facilitate portability of said tool set.

* * * * *